United States Patent [19]

Arnold

[11] 4,162,640

[45] Jul. 31, 1979

[54] HOSE-CLAMP PLIERS

[75] Inventor: Robert L. Arnold, Lancaster, Pa.

[73] Assignee: K-D Manufacturing Company, Lancaster, Pa.

[21] Appl. No.: 892,898

[22] Filed: Apr. 3, 1978

[51] Int. Cl.[2] ..... B25B 7/02

[52] U.S. Cl. ..... 81/311; 81/9.3

[58] Field of Search ..... 81/311, 312, 5.1 R, 81/9.3; 7/125; 29/268

[56] References Cited

U.S. PATENT DOCUMENTS

| | | | |
|---|---|---|---|
| 1,069,041 | 7/1913 | Strong | 81/5.1 R |
| 2,716,365 | 8/1955 | Keeley | 81/425 A |
| 2,898,789 | 8/1959 | Meese | 81/9.3 |

*Primary Examiner*—James L. Jones, Jr.
*Attorney, Agent, or Firm*—Paul & Paul

[57] ABSTRACT

A pair of pliers are provided for fastening a split annular hose clamp whose opposite ends are provided with ratchet teeth adapted for interlocking engagement. The pair of pliers has a pair of primary jaw members used in fastening the hose clamp and a pair of secondary jaw members used for removing the hose clamp by applying force in opposed lateral directions to the interlocked members. The primary jaw members and the secondary jaw members are located on the same side of the pivot stud remote from the plier's handles.

2 Claims, 9 Drawing Figures

HOSE-CLAMP PLIERS

BACKGROUND OF THE INVENTION

In the production and maintenance of motor vehicles and other equipments, it is frequently necessary to attach a flexible hose to a tubular metal fitting, as by inserting the fitting into the hose, and then securing the two by clamping the hose tightly on the fitting.

Split annular hose clamps of metal or of hard plastic material are available in which opposite ends of the split annulus are provided with interfitting interlocking fastening means.

More specifically, split annular hose clamps are available whose opposite ends are provided with ratchet teeth adapted to interfit into locking engagement such as to strongly resist unlocking in response to circumferential forces in the unlocking direction.

SUMMARY OF THE PRESENT INVENTION

A principal object of the present invention is to provide a novel tool, and specifically a pair of pliers, of a design to enable ready fastening and locking of the hose clamp and also ready unlocking and removal.

A more specific object is to provide hose clamp pliers of a design adapted (1) for quick and easy fastening of a split annulus hose clamp having ratchet teeth at its opposite ends which in response to a closing force interfit into locking engagement and (2) also adapted for quick and easy unfastening of the interlocked ratchet teeth.

The above objects are accomplished by providing a pair of pliers having a pair of primary jaws for applying a closing force in the circumferential direction and having a pair of secondary jaws for applying unfastening forces in opposite lateral directions.

DETAILED DESCRIPTION OF THE PREFERRED EMBODIMENTS

Figure 1:
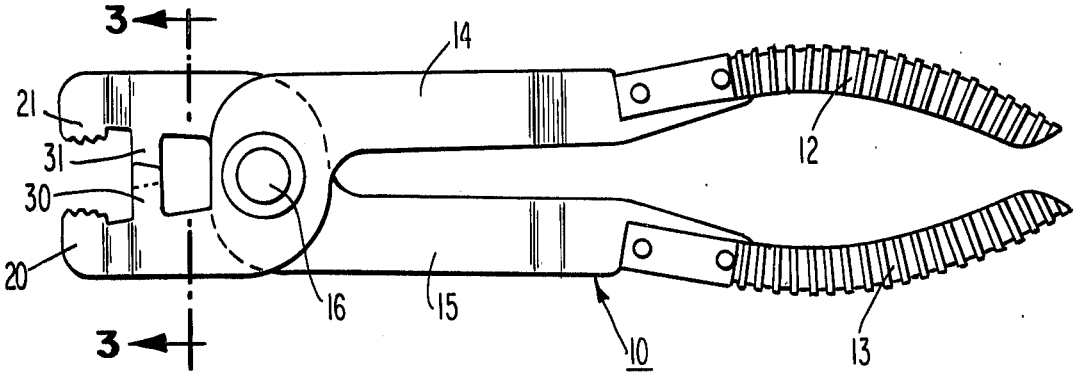
FIG. 1 is a plan view of hose clamp pliers embodying the present invention.

The hose clamp pliers 10 of the present invention comprise a pair of handles 12 and 13 secured, as by rivets, to a pair of lever arms 14 and 15. Lever arms 14 and 15 are mounted for pivotal movement on a common stud 16, and are secured as by a nut 17. A washer 18 is preferably placed under the head of the stud 16. Each of the lever members 14 and 15 terminates at its forward end in a principal jaw member 20 and 21, respectively. These jaw members are provided, as is customary, with serrated surfaces, and, when the plier's are fully closed, as illustrated in FIG. 1, the serrated surfaces face each other at substantial spaced separation.

Figure 2:
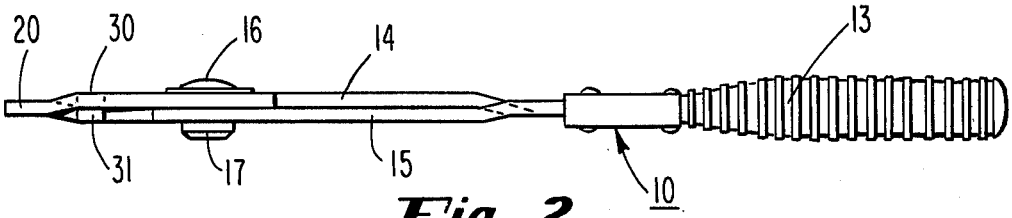
FIG. 2 is a side view of the hose clamp pliers of FIG. 1.
Figure 3:
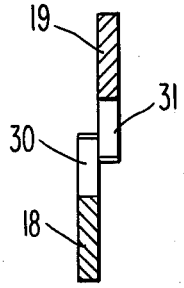
FIG. 3 is a view, in section, looking along the line 3—3 of FIG. 1.

In accordance with the present invention, a pair of secondary jaw members 30,31 are provided in the forward portion of lever arms 14,15 rearward of the principal jaw members 20 and 21, that is, between the principal jaw members and the pivot stud 16. These secondary jaw members 30 and 31 extend toward each other and, when the pliers are fully closed, the ends of the secondary jaw members 30 and 31 overlap each other, as illustrated in FIG. 1. To allow for such overlap, the two secondary jaw members 30 and 31 are offset relative to each other, as seen in FIGS. 2 and 3.

Figure 4:
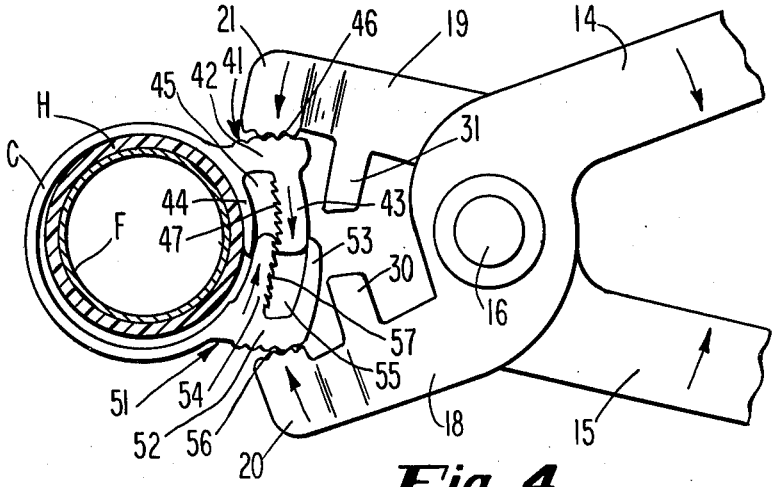
FIG. 4 is a fragmentary view illustrating how the primary jaw members of the hose clamp pliers are applied to the interlocking means at the start of the fastening procedure.

FIG. 4 illustrates the pliers of the present invention in a position to start tightening the split annular clamp C on the hose H and fitting F. As seen in FIG. 4, each end of clamp C is provided with ratchet tooth fastening means identified generally by the reference numerals 41 and 51. The term "ratchet tooth" is here used to refer to a tooth one side of which is perpendicular or almost perpendicular to the base, and the other side of which is inclined at a relatively shallow angle. Fastening means 41 consists of an upper arm 43 and a lower arm 44 each of which extends generally circumferentially. The upper and lower arms are connected by a radial portion 42. The under surface of upper arm 43 is provided with ratchet teeth 47. Fastening means 51 at the other end comprises upper arm 53, lower arm 54 and a generally radial interconnecting portion 52. The upper surface of the lower arm 54 is provided with ratchet teeth 57. The space between the upper and lower arms 43,44 of locking means 41 is identified 45, and the space between upper and lower arms 53,54 of locking means 51 is identified 55.

It will be seen from FIG. 4 that when the clamp is placed around the hose H, the upper arm 43 of locking means 41 is positioned to be received within the space 55 of the other locking means 51. The ratchet teeth on the under surface of upper arm 43 and on the upper surface of lower arm 54 are so oriented that when the plier's primary jaws 20,21 are placed on the radial outer surfaces 46,56 of the locking means 41,51 as illustrated in FIG. 4 and pressure is applied to the handles 12,13 in a closing direction to force upper arm 43 into space 55, the shallow angled surfaces of the teeth of arm 43 engage and slide over the shallow angled surfaces of the teeth of lower arm 54.

Figure 5:
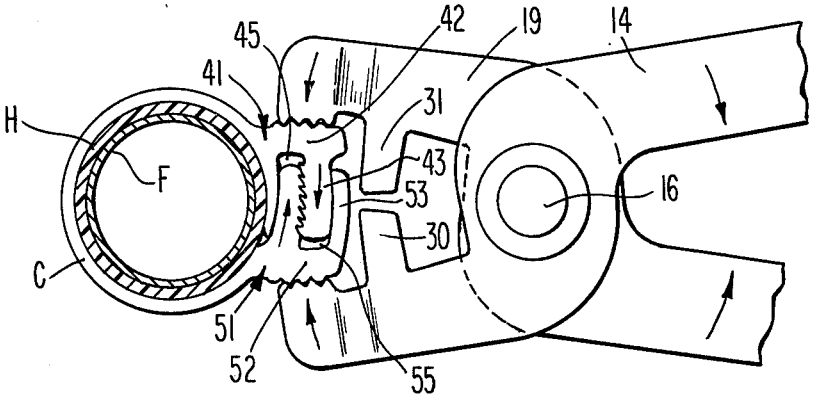
FIG. 5 is a fragmentary view generally similar to FIG. 4 but showing the pliers applied to the hose clamp at the finish of the fastening procedure.

When the clamp C is fully tightened, as illustrated in FIG. 5, and closing pressure is removed from handles 12,13, the perpendicular or radial surfaces of the ratchet teeth 47,57, engage each other, thereby locking the clamp C tightly about the hose H and fitting F.

Once the teeth 47,57 have been locked, it is virtually impossible to pull arm 43 out of the space 55 in the direction opposite to that used during engagement. While this is a highly desirable situation so far as maintaining the clamp in tightened condition is concerned it creates a problem so far as removal is concerned.

The function of the novel pliers of the present application is to make it easy to unlock the latch and remove the clamp.

Figure 6:
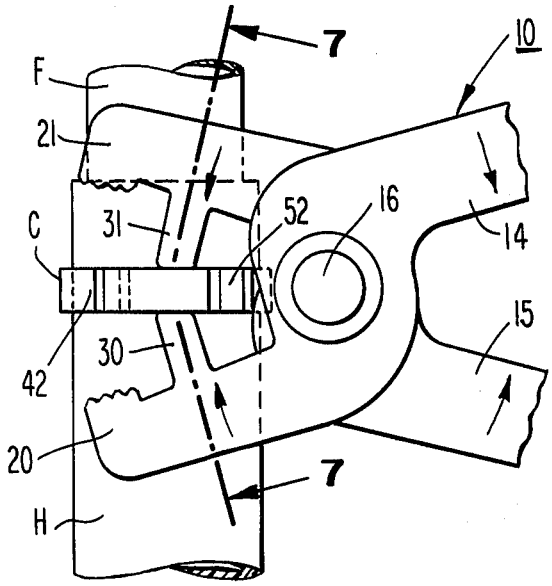
FIG. 6 is a fragmentary view illustrating the use of the secondary jaw members of the hose clamp pliers at the start of the unlocking procedure.
Figure 7:
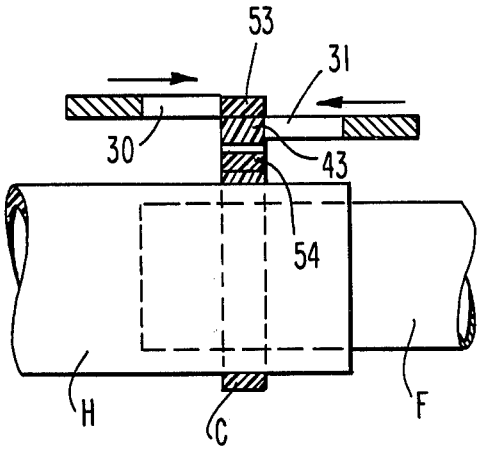
FIG. 7 is a view, in section, looking along the line 7—7 of FIG. 6.
Figure 8:
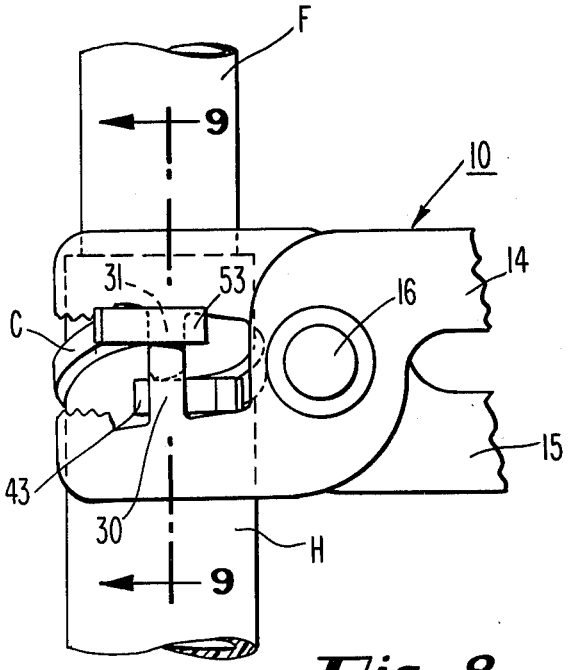
FIG. 8 illustrates the positions of the locking ends of the hose clamp after the clamp has been opened.
Figure 9:
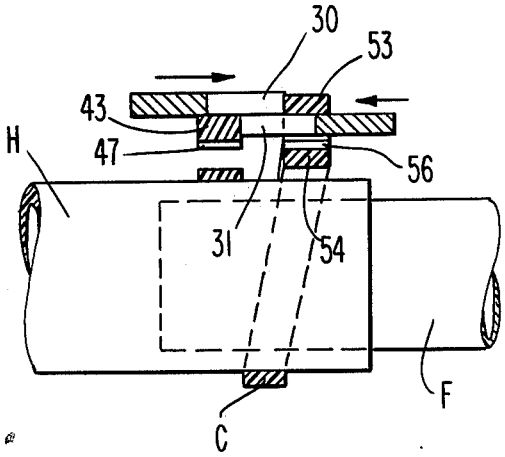
FIG. 9 is a view, in section, looking along the line 9—9 of FIG. 8.

To disengage the interlocked members 41,51, lateral thrust in opposing directions is applied by the secondary jaw members 30,31 to the side surfaces of arms 43 and 53. This is done by placing the pliers in the position illustrated in FIG. 6 in which the principal jaw members 20,21 face the sidewalls of radial portion 42, and the other radial portion 52 is on the longitudinal axis of the pliers close to the pivot stud 16. In this position, the secondary jaw member 30 bears against upper arm 53 of 51 while secondary jaw member 31 bears against upper arm 43 of 41. This is illustrated in FIG. 7. When the plier's handles are moved in a closing direction, thrust is applied in opposing directions to opposite surfaces of arms 53 and 43. This causes the arms 43,53 to slide laterally on their respective teeth 47,57 to take up the positions shown in FIGS. 8 and 9 in which the teeth 47,57 are separated laterally, thus unlocking the interlock and allowing removal of the clamp.

In FIG. 3, little or no lateral spacing is shown between the secondary jaw members 30 and 31 when they are in overlapped position. Preferably, some slight spacing is desirable. To unfasten the clamp, the interlocked arms 43,54 may be separated by lateral movement by placing the terminal ends of the secondary jaw members 31 and 30 against opposite sides of upper arms 43 and 53 respectively, in the positions illustrated in FIG. 7. As there shown, the end of jaw 30 is placed on one side of arm 53 and the end of jaw 31 is placed on the opposite side of arm 43, and thrust in opposing directions is then applied by closing the pliers. If sufficient lateral spacing be provided between the overlapping secondary jaw members 30 and 31, lateral separation of arms 43 and 53 may be accomplished by placing jaw members 31 and 30 respectively on upper arm 43 and lower arm 54 in such position that the teeth 47,57 fall within the spacing between the two secondary jaw members.

I claim:

1. A pair of pliers for use in fastening and unfastening a split annular hose clamp having fastening means at each of its two ends adapted to interlock with each other, said fastening means comprising outward radial extensions spaced circumferentially inward from the terminal ends of the split annulus, and arms extending circumferentially toward each other from said radial extension spaced from and substantially parallel with the terminal portions of said annulus, one of said arms being provided with a set of ratchet teeth on its inward edge adapted to engage in interlocking relationship with ratchet teeth on the outward edge of one terminal portion of said annulus, said pliers comprising:

a. first and second lever arms;
b. a pivot stud on which said first and second lever arms are mounted for pivotal movement;
c. handle means at the rearward ends of said first and second lever arms;
d. primary jaw members at the forward ends of said first and second lever arms;
e. secondary jaw members on said first and second lever arms rearward of said primary jaw members but forward of said pivot stud;
f. Said primary jaw members facing each other at substantial spaced separation when said pliers are fully closed;
g. said secondary jaw members extending toward each other and moving into overlapping relation when said pliers are closed;
h. said primary jaw members being adapted to engage the outer surfaces of said radial extensions of said fastening means of said hose clamp for applying thrust forces in opposing directions when said pliers are moved in a closing direction to cause low angled surfaces of said ratchet teeth to slide over each other toward interlocked position;
i. said secondary jaw means being adapted to bear against opposite sidewalls on either side of said ratchet teeth for applying thrust forces in opposite lateral directions when said pliers are moved in a closing direction to cause said interlocked ratchet teeth to slide laterally in opposing directions into disengaged positions.

2. A pair of pliers for use in fastening and unfastening a hose clamp having ratchet teeth interlocking means at the two ends of a split annulus, said pair of pliers comprising:

a. first and second levers;
b. a pivot stud on which said first and second levers are mounted for pivotal movement;
c. first and second primary jaw members at the forward ends of said first and second levers;
d. first and second secondary jaw members at the forward end of said first and second levers, said secondary jaw members being located rearward of said primary jaw members and forward of said pivot stud, said secondary jaw members extending toward each other to take up overlapping positions when said pliers are closed, said first and second primary jaw members being at substantial spaced separation when said pliers are closed.

* * * * *